United States Patent [19]

McQuade

[11] Patent Number: 4,856,791

[45] Date of Patent: Aug. 15, 1989

[54] PROTECTIVE MAT ASSEMBLY AND INSTALLATION METHOD THEREFOR

[75] Inventor: John O. McQuade, Cheshire, Conn.

[73] Assignee: Linatex Corporation of America, Stafford Springs, Conn.

[21] Appl. No.: 239,620

[22] Filed: Sep. 1, 1988

[51] Int. Cl.[4] ..... F41J 1/20; F41J 1/12

[52] U.S. Cl. ..... 273/410

[58] Field of Search ..... 273/403, 404, 410

[56] References Cited

U.S. PATENT DOCUMENTS 4,317,572 3/1982 Iseli ..... 273/404 X
4,683,688 8/1987 Worcinski ..... 273/410 X
4,773,653 9/1988 Unverzagt ..... 273/404

FOREIGN PATENT DOCUMENTS 3212781 10/1983 Fed. Rep. of Germany ..... 273/410
3442984 5/1986 Fed. Rep. of Germany ..... 273/410

OTHER PUBLICATIONS

Linatex Corporation of America Advertising Circular 9-1984.

*Primary Examiner*—Paul E. Shapiro
*Attorney, Agent, or Firm*—Chilton, Alix & Van Kirk

[57] ABSTRACT

A ballistic mat assembly and installation method therefor employ a sheet of elastomeric material and a cellular foam substrate which are mounted to a rigid panel. The panel is mounted to an armor steel plate by driving fasteners through the elastomeric material and the substrate to secure the panel to the metal plate. Projectiles which strike the asssembly impact against the plate and projectile fragmentation is contained within the assembly.

16 Claims, 3 Drawing Sheets

PROTECTIVE MAT ASSEMBLY AND INSTALLATION METHOD THEREFOR

BACKGROUND OF THE INVENTION

This invention relates generally to ballistic fragment containment materials. More particularly, the present invention relates to protective materials employed for the walls, floors and ceilings of target ranges to entrap stray or misdirected bullets and to prevent projectiles from striking or ricocheting off of the walls, floors, and ceilings of confined target ranges.

The adverse environmental effects and the accidental injuries which may result from the ricocheting of bullets at target ranges has long been recognized. Numerous devices and materials have been advanced to address the serious problems associated with lead back splatter and fragmentation and the ricocheting of projectiles at target ranges. For example, sheets of materials such as canvas, plywood and particle board have been mounted behind target backing curtains to reduce the back splatter of lead. Bullet traps of various forms and configurations have been advanced to entrap the spent bullets. The noted safety and environmental problems are particularly critical for indoor target ranges.

U.S. patent application No. 005,210 filed on Jan. 10, 1987 and entitled "Cover For Ballistic Target Assembly", and assigned to the assignee of the present invention, discloses a new and improved splatter resistant cover for a ballistic target. The cover slips over the target. The target cover employs a tough, long lasting elastomeric material to reduce the back splatter from bullets striking the target. The cover has very favorable fragment containment characteristics. When the cover is employed in combination with an armor proof target plate, the cover is adapted to retain the back splatter from projectiles which strike the target assembly. A rear panel and a side panel connect the front and rear panel so as to form an envelope which surrounds the metal target. The front panel of elastomeric material is spaced from the target to form a cavity between the target face and the front panel to capture and confine projectile fragments. A projectile directed at the target face penetrates the front panel of elastomeric material and strikes the target face to disintegrate into fragments which are generally initially confined within the target and controllably discharged to the base of the target. The employed elastomeric material preferably has very low elastic modulus and a high elongation to break.

U.S. patent application No. 207,340 filed on June 15, 1988 and entitled "Device for Entrapment of Projectiles", and assigned to the assignee of the present invention, discloses a novel device for the entrapment of projectiles. The device comprises a front panel of elastomeric material, a rear panel spaced from the front panel forming a cavity therebetween and an impact absorbent media disposed in the cavity space. Lead shot is one suitable absorbent media. A projectile fired at the entrapment device penetrates the front elastomeric panel. The fired projectile impacts against the lead shot with substantially complete projectile containment within the device.

Outdoor ranges are becoming difficult to establish and maintain due to urbanization and environmental regulations. Because of the environmental and governmental regulations of lead contamination and of safety associated with target ranges, portable or mobile target ranges which are easily moved from place to place have been advanced. For example, a trailer has been transformed into a mobile self-contained target range. The trailer can be pulled by means of a tractor from location to location to provide a target range suitable for various applications such as law enforcement training, government military forces training and security forces training. The mobile target range includes a liner for eliminating the ricocheting and back splatter of misdirected bullets as well as a conventional bullet trap and target backing materials. The present invention has particular applicability as an interior surface liner, e.g., walls, floors, and ceilings, along the target area so as to eliminate ricocheting and entrap misdirected projectiles.

SUMMARY OF THE INVENTION

Briefly stated, the invention in a preferred form is a protective ballistic mat assembly for a ballistic target range or the like. The assembly comprises a steel plate for absorbing the impact of a projectile and resisting penetration of the projectile. A support panel which is preferably a sheet of plywood overlies the steel plate. A cellular foam substrate is mounted against the support panel. An elastomeric sheet of material is mounted against the substrate. A plurality of fasteners secure the support panel to the steel plate. The fasteners have a securing head which engages the support panel and a shank which penetrates the steel plate. The fastener had is covered by the substrate and the elastomeric sheet. A projectile directed at the mat assembly, penetrates the elastomeric sheet and the substrate and strikes the armor plate in a fashion wherein projectile fragmentation is substantially completely retained between the elastomeric sheet and the plate.

The elastomeric sheet is a material having very high elongation properties and a very low elastic modulus. The fasteners are preferably in the forms of nails. The substrate may be bonded to the support panel by an adhesive. The elastomeric sheet may also be bonded to the substrate by an adhesive.

A method for installing a safety mat assembly comprises bonding an elastomeric sheet to a cellular substrate. The cellular substrate is bonded to a rigid panel to form a mat sub-assembly. The mat sub-assembly is positioned against an armor proof plate in generally surface to surface relationship. The panel is fastened to the plate by driving fasteners through the sub-assembly to secure the panel to the plate. The fasteners penetrate the elastomer sheet and substrate and are enclosed by the elastomeric sheet and the substrate.

An object of the invention is to provide a new and improved protective ballistic mat assembly and installation method therefor which is particularly adaptable for incorporation in connection with confined target ranges.

Another object of the invention is to provide a new and improved protective ballistic mat assembly and installation method therefor having ballistic fragment containment properties which reduces back splatter and provides a cleaner environment on a target range.

Another object of the invention is to provide a new and improved protective ballistic mat assembly which may be installed in position in a manner wherein the fasteners are not exteriorly exposed to ballistic projectiles and do not present a structure susceptible to causing hazardous ricocheting by such projectiles.

A further object of the invention is to provide a new and improved protective ballistic mat assembly which is relatively light weight compared to comparable materials, effectively prevents ricocheting of projectiles, has favorable fragmentation retainment properties and has a relatively small cross-sectional thickness.

A further object of the invention is to provide a new and improved protective ballistic mat assembly of efficient and inexpensive construction which may be relatively easily installed in a confined or enclosed target range and the like to effectively reduce projectile ricocheting and to entrap misdirected ballistic projectiles.

Other objects and advantages of the invention will become apparent from the specification and the drawings.

DETAILED DESCRIPTION OF THE INVENTION

Figure 1:
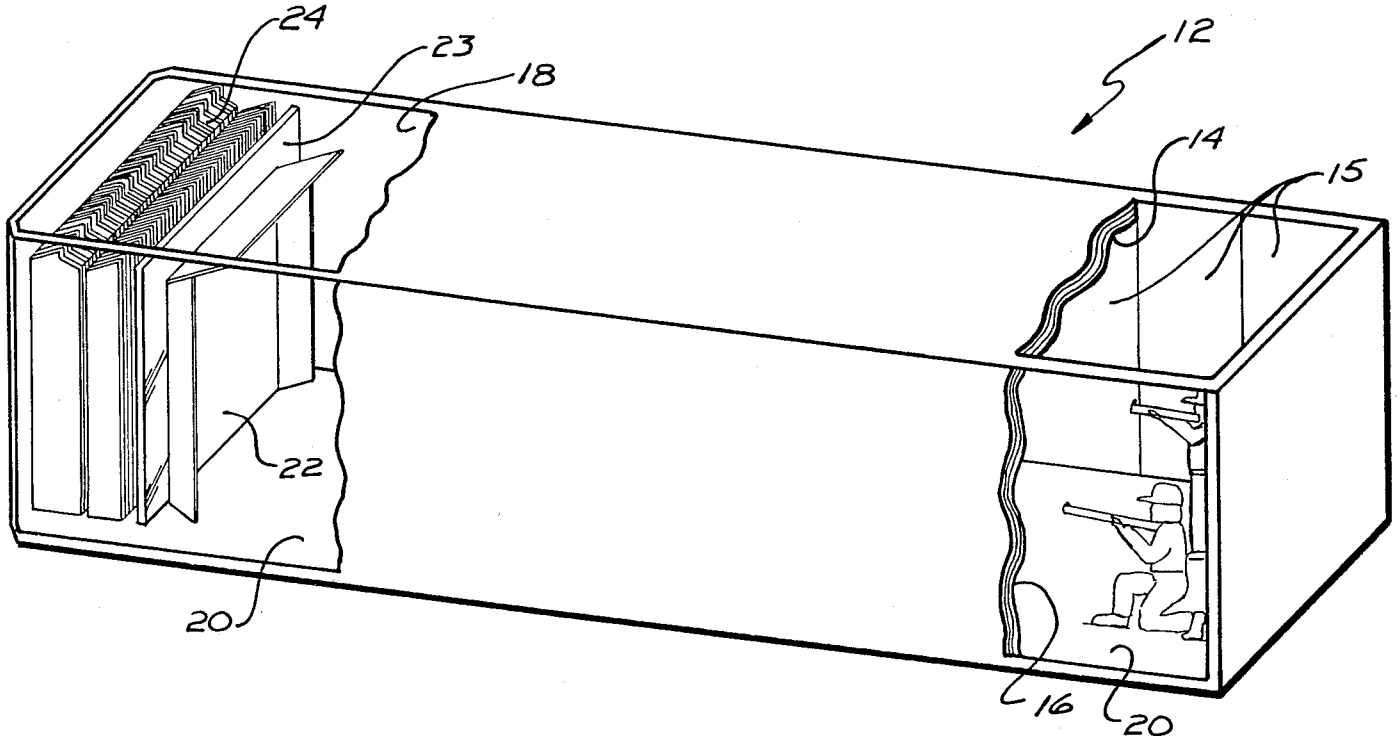
FIG. 1 is a fragmentary perspective view, partly broken away, illustrating an enclosed target range application of the protective ballistic mat assembly of the present invention.
Figure 2:
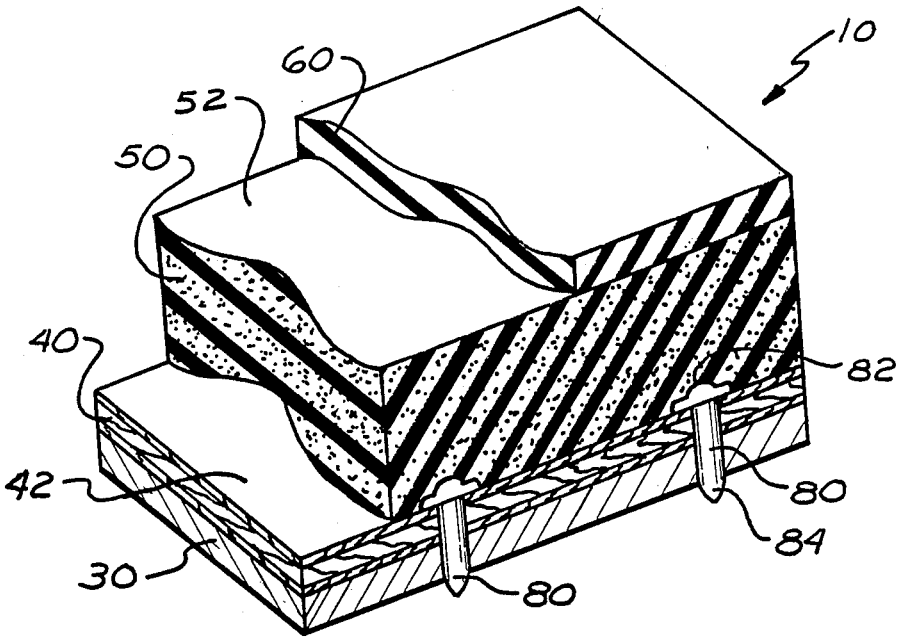
FIG. 2 is an enlarged fragmentary perspective view, partly broken away, of a portion of the protective ballistic mat assembly of the present invention.

With reference to the drawings wherein like numerals represent like parts throughout the Figures, a multilayered protective ballistic mat assembly in accordance with the present invention is generally designated by the numeral 10. The ballistic mat assembly 10 in accordance with the present invention has particular applicability as a safety barrier or liner in connection with a confined target range 12 as illustrated in FIG. 1. The mat assembly 10 may also be employed as a safety wall structure or enclosure for a mobile target range enclosed with a trailer (not illustrated).

In particular, the ballistic mat assembly 10 may be employed as a constituent material for the wall structure lining the target range including the interior ceiling 14, the side walls 16 and 18, and the floor 20. The illustrated target range 12 includes a target 22, a target backing curtain 23 and a bullet trap 24 positioned behind the target for capturing the ballistic projectiles. The target 22, curtain 23 and bullet trap 24 are not the specific focus of the present invention. The ballistic mat assembly 10 functions as a safety barrier which extends along the target range firing path to prevent ricocheting of misdirected bullets and to entrap the ballistic projectile fragments within the assembly.

The ballistic mat assembly is preferably partially preassembled in panels 15 or sheets which are then secured to the trailer or target range support structure as will be more fully described below. The panels 15 may typically be 4 feet by 8 feet by approximately 1½ inches, although the invention is not limited to a specific dimensional configuration. The thickness of a panel 15 may vary for a given application depending upon whether the panel is employed as a floor, ceiling or side wall.

With additional reference to FIGS. 2 through 6, the mat assembly 10 has a sandwich-like layered configuration. The mat assembly 10 comprises a steel plate 30 which is an armor proof plate for absorbing the impact of a ballistic projectile and resisting projectile penetration. The steel plate 30 typically has a thickness on the order of ¼ inch. The steel plate 30 may form the exterior walls of the target range 12 or the exterior walls of the target range enclosure.

A semi-rigid panel 40 of plywood, particle board or other similar material which may typically have a thickness on the order of ¼ inch overlies the steel plate 30. In one embodiment, the panel 40 is a standard ¼ inch plywood sheet. A cellular foam substrate 50 typically having a substantially uniform thickness of one inch overlies the plywood panel 40. The foam substrate 50 may have various physical compositions. A suitable material is "Ensolite HHC" marketed by Uniroyal, Inc. The foam substrate 50 is bonded by an adhesive 42 to the plywood panel 40. A suitable adhesive 42 is "Linatex 1412" rubber cement, a product of Linatex Corporation of America, Stafford Springs, Conn.

The outer exposed material of the mat assembly 10 (constituting the interior wall surface closest to the target range firing path) is an elastomeric sheet 60 typically having a substantially uniform thickness on the order of ¼ inch. The foregoing elastomeric sheet 60 is bonded by an adhesive 52 directly to the foam substrate 50. A suitable adhesive 52 is "Linatex 1412" rubber cement. In preferred form, the elastomeric sheet 60 is a natural rubber product marketed under the name "Linatex" by the Linatex Corporation of America, Stafford Springs, Conn. The elastomeric sheet 60 is a sheet of elastomeric material having very high elongation characteristics and a very low elastic modulus. The noted "Linatex" elastomeric material has a high concentration of pure and natural rubber latex with a durometer hardness of 40 on the Shore A scale, a density of 0.98 grams/cc, a tensile strength of 3,000 psi normal, and a very high elongation at break on the order of approximately 800% to 1000%. Other elastomeric materials may also be employed such as natural rubber, e.g., cis-polyisoprene or trans-polyisoprene as well as synthetic elastomers such as neoprene, ethylene propylene terpolymers, modified polyolefins including chlorosulfonated polyethylene, butadiene-styrene or butadiene-acrylonitrile copolymers, and isobutyl or polyurethane rubbers.

Figure 6:
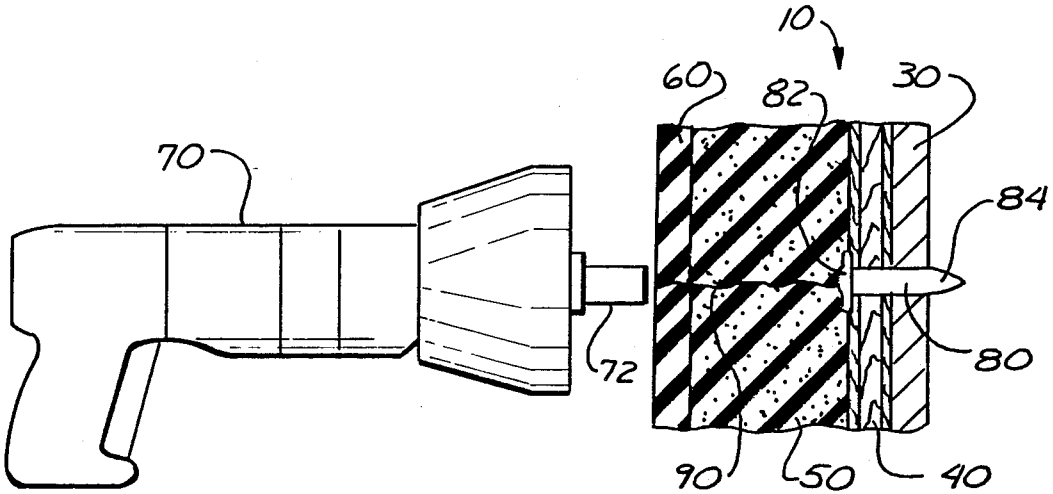
FIG. 6 is an enlarged fragmentary sectional view of the mat assembly of FIG. 2 and side view of a fastener gun, illustrating the installation method of the present invention.

In preferred form, the ballistic mat sub-assembly comprising the bonded elastomeric sheet 60, foam substrate 50, and panel 40 are pre-assembled in panels 15. The panels 15 are then mounted against the steel plate 30. The sub-assembly panels 15 are secured in place to the steel plate 30 by means of a ballistically, pneumatically or mechanically fired fastener gun 70. The fastener gun 70 propels nails or fasteners 80 through the outer elastomeric sheet 60 and the foam substrate 50 into the plywood panel 40 so as to secure the sub-assembly panel 15 to the steel plate 30. One gun 70 having a retractable plunger 72, such as schematically illustrated in FIG. 6, suitable for mounting or installing the ballistic mat subassembly panel 15 is the Model 600N gun manufactured by Hilti Manufacturing Company of Tulsa, Okla.

Each fastener 80 is preferably a steel nail or similar fastener comprising a head 82 and an integral pointed shank 84. The gun 70 is serially placed against the elastomer sheet 60 at spaced intervals and discharged. The fasteners 80 substantially entirely penetrate the outer elastomeric sheet 60 and the underlying cellular foam substrate 50. The fastener shanks 84 further pierce the plywood panel 40 and penetrate the steel plate 30. The travel of the fastener terminates in the steel plate. Each fastener head 82 is engageably positioned against the outer surface of the plywood panel 40. Because of the elastomeric characteristics of the foam substrate 50 and the outer elastomeric sheet 60, the opening 90 (schematically illustrated in FIG. 6) created by the penetration of the fastener 80 is hardly perceptible and does not affect in any significant manner the projectile containment properties of the mat assembly. The highly resilient cut-and-tear resistant elastomeric sheet 60 exhibits highly responsive and very favorable self-sealing characteristics about the penetration opening 90 produced in the elastomeric sheet 60 under the high velocity impact of the fastener. The elastomeric material in the vicinity of the fastener penetration rapidly recovers to a normal state so that the opening 90 developed by the penetrating fastener is nearly entirely re-closed by the internal elastic and compressive forces within the elastomeric sheet. Consequently, the mat assembly 10 may be efficiently installed without directly exposing the installation fasteners 80 to a fired projectile or without the fasteners being directly located in an unobstructed projectile flight path. Thus, directed and/or ricocheting projectiles do not directly impact on the embedded fasteners 80 to thereby present a safety problem.

Figure 3:
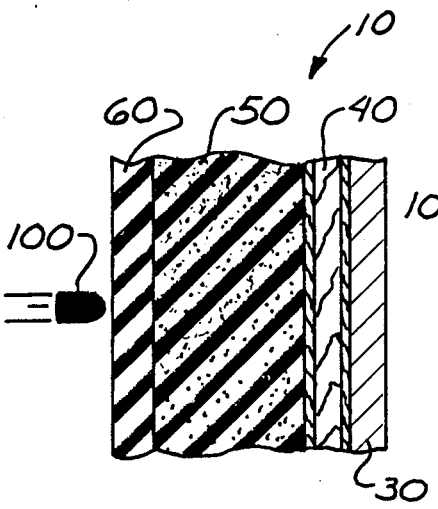
FIG. 3 is an enlarged fragmentary sectional view of the protective ballistic mat assembly of the present invention and a ballistic projectile, partly in schematic, prior to the mat assembly being impacted by the ballistic projectile.
Figure 4:
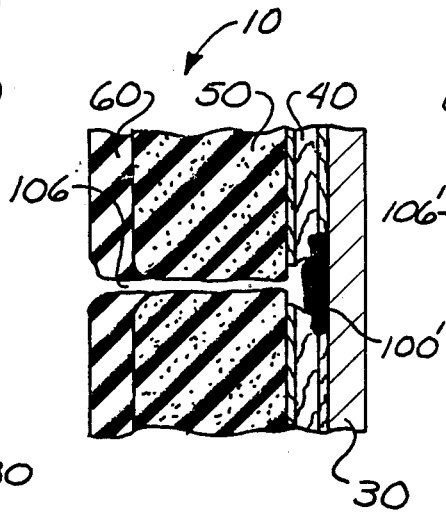
FIG. 4 is an enlarged fragmentary sectional view, partly in schematic, of the mat assembly portion and projectile of FIG. 3 shortly after the impact of the projectile.
Figure 5:
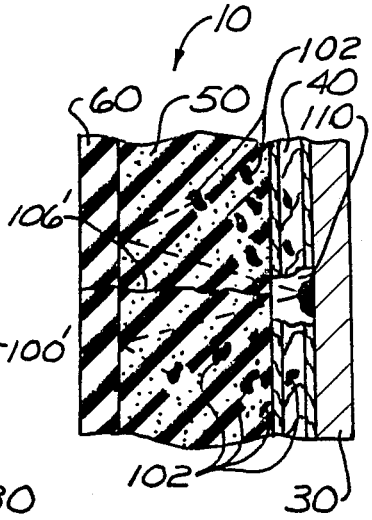
FIG. 5 is an enlarged fragmentary sectional view, partly in schematic, of the mat assembly portion and projectile of FIG. 3 illustrating the fragment containment characteristics of the mat assembly subsequent to the impact by a projectile.

With reference to FIGS. 3 through 5, the mat assembly 10 functions so that a projectile 100 which impinges the assembly easily penetrates the outer elastomeric sheet 60 and the foam substrate 50 to impact against the plywood panel 40 and the steel plate 30. The impacting projectile 100 is essentially arrested and splattered by the steel plate 30, thus producing back splatter and lead fragments 102 as best illustrated in FIG. 5. The elastomeric resilient properties of the outer elastomeric layer function to deflect and contain the lead fragments between the steel plate 30 and the elastomeric sheet 40 as best illustrated in FIG. 5. Two lead fragment paths are schematically denoted by broken lines in FIG. 5 to illustrate the containment properties of the mat assembly.

The initial projectile opening 106 formed in the elastomeric sheet 60 and the cellular substrate 50 rapidly resiliently recovers to a quasi-original state in a manner wherein the transformed opening 106 is nearly entirely re-closed due to the internal elastic and compressive forces within the sheet 60 and the substrate 50. A small portion of the panel 40 may disintegrate to form a small cavity 110 in the vicinity of the projectile/plate impact. Otherwise, the mat assembly remains generally structurally intact upon being struck by the fired projectile 100.

In one installation of the ballistic mat assembly, the ceiling 14, floor 20 and walls 16 and 18 of a mobile target range enclosure were constructed from the mat assembly as previously described to form a range enclosure having sidewalls approximately 8 feet high and 40 feet long. 0.45 caliber rounds of ammunition were repeatedly fired at close range into the mat assembly 10. The combined thickness of sheet 60 and substrate 50 3 was approximately $1\frac{1}{4}$ inches. The plywood panel 40 was not employed in the foregoing test. After firing, the mat assembly was disassembled and sectioned. It was found that substantially complete containment of the rounds within the mat assembly was achieved. It was evident that rounds had penetrated the outer elastomeric sheet 60 upon entry leaving only insignificant pinhead size openings. The rounds then further penetrated the foam layer and impacted against the steel plate. The rounds were disintegrated by the steel plate. The bullet fragments were scattered and retained within the interstices of the cellular foam substrate 50 between the elastomeric sheet 60 and the steel plate 30.

It should be appreciated that the invention as described may be advantageously employed as a safety barrier in the construction and operation of fixed and mobile shooting galleries, ammunition loading facilities, military training facilities or in any environment where there is potential for personal injury from ricocheting, back splattering or lead contamination resulting from the firing of live ammunition.

The mat assembly 10 as described functions to significantly enhance the safety of target shooters. Even when the mat assembly is struck by a projectile directed at a very shallow angle to the mat assembly surface, the projectile passes through the elastomeric outer sheet 60 and becomes entrapped between the elastomeric sheet 60 and the armor plate 30. The outer elastomeric sheet 60 prevents the projectile and/or fragments thereof from re-entering the target range or the shooting environment thereby protecting the shooter. Naturally, the containment of the fragmentation from spent rounds reduces the entry of fine particulate lead dust into the atmosphere and thus reduces potentially harmful buildup of lead in the exterior target range environment.

The composition of the mat also is significant in that it is significantly lighter in weight than the corresponding weight of solid rubber matting which has been used for similar purposes in prior installations. In one application, the mat assembly is approximately 60% lighter than conventional target range rubber wall liner while providing at least an equivalent, if not improved, degree of safety protection. Consequently, less support and reinforcement structure is required for the mat assembly 10, and it is more suitable for mobile galleries or target ranges. The preferred "Linatex" elastomeric sheet 60 also has the beneficial effect of providing a surface shade (reddish tint) which is lighter in tone than conventional black rubber sheets. The black rubber sheets tend to present a "dark tunnel" effect to the shooter especially for enclosed narrow and long target ranges. In addition, the penetration of the installation fasteners 80 within the mat assembly so as to be embedded therein as described obviates the potential for ricocheting of rounds striking exposed fastener heads.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A protective mat assembly for a ballistic target range or the like comprising:

plate means for absorbing the impact of a projectile and resisting the penetration thereof;

support panel means overlying said plate means;

cover means comprising a cellular foam substrate and an elastomeric sheet, said support panel means being disposed between said plate means and said cover means; and a plurality of fasteners securing said support panel means to said plate means, said fasteners having a securing head which engages said support panel means and a shank which penetrates said plate means, said head being substantially covered by said cover means, so that a projectile directed at said assembly penetrates said cover means and strikes said plate means wherein any projectile fragmentation is substantially completely contained within said assembly.

2. The protective mat assembly of claim 1 wherein said cellular substrate is disposed between said elastomeric sheet and said panel means.

3. The protective mat assembly of claim 1 wherein said plate means is an armor steel plate.

4. The protective mat assembly of claim 1 wherein said support panel means is a generally rigid structure.

5. The protective mat assembly of claim 1 wherein said support panel means is a sheet of plywood.

6. The protective mat assembly of claim 1 wherein said elastomeric sheet is material having high elongation to break characteristics and a very low elastic modulus.

7. The protective mat assembly of claim 1 wherein the fasteners comprise a plurality of nails.

8. The protective mat assembly of claim 1 wherein any projectile fragmentation is substantially completely contained between said elastomeric sheet and said plate means.

9. The protective mat assembly of claim 2 wherein said elastomeric sheet is bonded to said substrate by means of an adhesive.

10. The protective mat assembly of claim 2 wherein said substrate is bonded to said support panel means by means of an adhesive.

11. A method for installing a protective mat assembly comprising:

(a) bonding an elastomeric sheet to a cellular substrate;

(b) bonding said cellular substrate to a rigid panel to form a mat sub-assembly;

(c) positioning said mat sub-assembly against an armor proof plate so that said panel generally engages said plate in surface-to-surface relationship; and (d) fastening said panel to said plate by driving fasteners through said sheet and substrate to engage against said panel and secure said panel to said plate.

12. The installation method of claim 11 wherein step (d) comprises positioning a ballistic fastener gun against said sheet and discharging said gun to drive fasteners through said elastomer sheet and said substrate so that said fasteners are covered by said sheet and said substrate.

13. A target range enclosure defined by four walls, including a floor and a ceiling, at least one of said walls comprising a protective mat assembly encompassing substantially the entire extent thereof, said protective mat assembly comprising:

outer plate means for absorbing the impact of a projectile and resisting the penetration thereof;

support panel means overlying said plate means;

a cellular substrate;

an elastomeric sheet of material defining an interior enclosure surface, said substrate being disposed between said elastomeric sheet and said panel means; and a plurality of fasteners securing said support panel means to said plate means, said fasteners having a securing head which engages said support panel means and a shank which penetrates said plate means, said head being substantially covered by said substrate and said elastomeric sheet, so that a projectile directed at said assembly penetrates said elastomeric sheet and said substrate and strikes said plate means wherein any projectile fragmentation is substantially completely contained within said assembly.

14. The target range enclosure of claim 13 wherein each of said four walls comprise said protective mat assembly.

15. The target range enclosure of claim 13 wherein said elastomeric sheet is a natural rubber material having a very low elastic modulus and high elongation to break properties.

16. The target range enclosure of claim 13 wherein said elastomer sheet is bonded to said substrate and said substrate is bonded to said support means by means of adhesive.

* * * * *